US005741155A

United States Patent [19]

Herman

[11] Patent Number: 5,741,155

[45] Date of Patent: Apr. 21, 1998

[54] CABLE CONNECTOR GENDER CHANGER

[75] Inventor: Steven Charles Herman, Poway, Calif.

[73] Assignee: NCR Corporation, Dayton, Ohio

[21] Appl. No.: 580,013

[22] Filed: Dec. 20, 1995

[51] Int. Cl.[6] ..... H01R 11/00

[52] U.S. Cl. ..... 439/502; 439/610; 439/654

[58] Field of Search ..... 439/451, 459, 439/502, 505, 498, 499, 654, 655, 638, 639, 607, 610

[56] References Cited

U.S. PATENT DOCUMENTS

| | | | |
|---|---|---|---|
| 4,236,779 | 12/1980 | Tang | 439/610 |
| 4,941,845 | 7/1990 | Eppley et al. | 439/505 |
| 4,954,101 | 9/1990 | Nelson | 439/502 |
| 5,099,137 | 3/1992 | Lattin, Jr. . | |
| 5,233,692 | 8/1993 | Gajjar et al. . | |
| 5,313,595 | 5/1994 | Lewis et al. . | |

OTHER PUBLICATIONS

"SCS1-2 Working Draft Proposal" –Draft prepared by American National Standard for Information System, Aug. 22, 1989.

"AHA-1540CF/1542CF, High Performance Bus Master ISA to SCSI Host Adapter with SCSISelect™ Installation Guide", Adaptec, Inc., 1993.

"AT&T 3600 Quadratic SCSI Adapter Feature Description and Installation, Issue 1", AT&T, 1993.

*Primary Examiner*—Gary F. Paumen
*Assistant Examiner*—Christopher Goins
*Attorney, Agent, or Firm*—Merchant, Gould, Smith, Edell, Welter & Schmidt

[57] ABSTRACT

A cable connector gender changer for SCSI cables allows a male cable connector to connect to another male cable connector. The cable connector gender changer comprises a first metal socket connectable to the male cable connector, a second metal socket connectable to another male cable connector, an intermediate portion for connecting the first and second metal sockets, and a plurality of electrical connections extending from the first metal socket to the second metal socket through the intermediate portion. The dimensions of the sockets comply with SCSI standards, so they can mate with standard SCSI cable connectors. The gender changer has a continuous EMI shield from one socket to the other and is post-molded for appearance.

11 Claims, 3 Drawing Sheets

CABLE CONNECTOR GENDER CHANGER

CROSS-REFERENCE TO RELATED APPLICATIONS

This application is related to application Ser. No. 08/580,025, entitled "CABLE ASSEMBLY," filed on same date herewith, by Steve Herman, and assigned to the assignee of this application, which application is incorporated by reference herein.

BACKGROUND OF THE INVENTION

1. Field of the Invention

The present invention generally relates to a cable connector gender changer, and more particularly, to a cable connector gender changer used in conjunction with a cable assembly for forming SCSI buses that can be efficiently connected to SCSI adapter boards.

2. Description of Related Art

The Small Computer System Interface (SCSI) bus is an industry-standard and ANSI-standard specification for electrical busses used for computers and their peripheral devices. Information regarding SCSI bus standards may be found in numerous publications, including those from the American National Standards Institute.

A SCSI bus is normally used for communications between computers and peripheral devices, among multiple peripheral devices, and among multiple computers. Typically, a computer has a SCSI adapter or controller attached thereto that directly couples the computer to the SCSI bus and that performs lower levels of SCSI protocol. The adapter normally acts as an "initiator" of an I/O request to another device known as a "target." Targets may comprise adapters or controllers for other computers or peripheral devices coupled to the SCSI bus. A plurality of SCSI devices (whether they are initiators or targets) may be daisy-chained together. A SCSI bus is shared when there are multiple initiators thereon, and is unshared when there is only a single initiator thereon. Further, both ends of the SCSI bus are terminated to prevent noise and to maintain the SCSI bus in a known state.

Generally, a SCSI bus cable comprises a plurality of separately insulated conductors that twist around each other inside grounding shield and insulating layers to form a substantially rounded cross-section. The "narrow" SCSI bus standard uses cables having fifty conductors, while the "wide" SCSI bus standard uses cables having sixty-eight conductors.

The combination of separate conductors, grounding shield layers, and insulating layers makes SCSI cables thick and cumbersome. Standard connectors used for SCSI cables are also thick and cumbersome, because they need to provide pins for fifty or sixty-eight conductors, maintain grounding, and provide protection against electro-magnetic interference (EMI).

At the end of each SCSI cable is a connector for allowing the SCSI cable to electrically connect to other cables or devices. Standard SCSI connectors are either male-type or female-type. In the novel cable assembly of the co-pending application cited above, each SCSI cable is typically manufactured having a male-type connector at one end and a female-type connector at its other end, which allows two cable assemblies to be connected together by pairing up male and female connectors of the different SCSI cables.

Such an assembly provides convenience and flexibility for connections, as well as simplifying the manufacture and assembly of the cable assembly itself. However, this flexibility is limited by the fact that only male-type terminators, for coupling to female connectors, are currently available for SCSI cables. Thus, to increase the usability of the cable assembly, there is a need in the art for improved cable connector gender changer for use with SCSI cables.

SUMMARY OF THE INVENTION

To overcome the limitations described above, and to overcome other limitations that will become apparent upon reading and understanding the present specification, the present invention discloses a cable connector gender changer for SCSI cables that allows a male cable connector to connect to another male cable connector or a male terminator. The cable connector gender changer comprises a first metal socket connectable to the male cable connector, a second metal socket connectable to another male cable connector, an intermediate portion for connecting the first and second metal sockets, and a plurality of electrical connections extending from the first metal socket to the second metal socket through the intermediate portion. The dimensions of the sockets comply with SCSI standards, so they can mate with standard SCSI cable connectors.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

Figure 1:
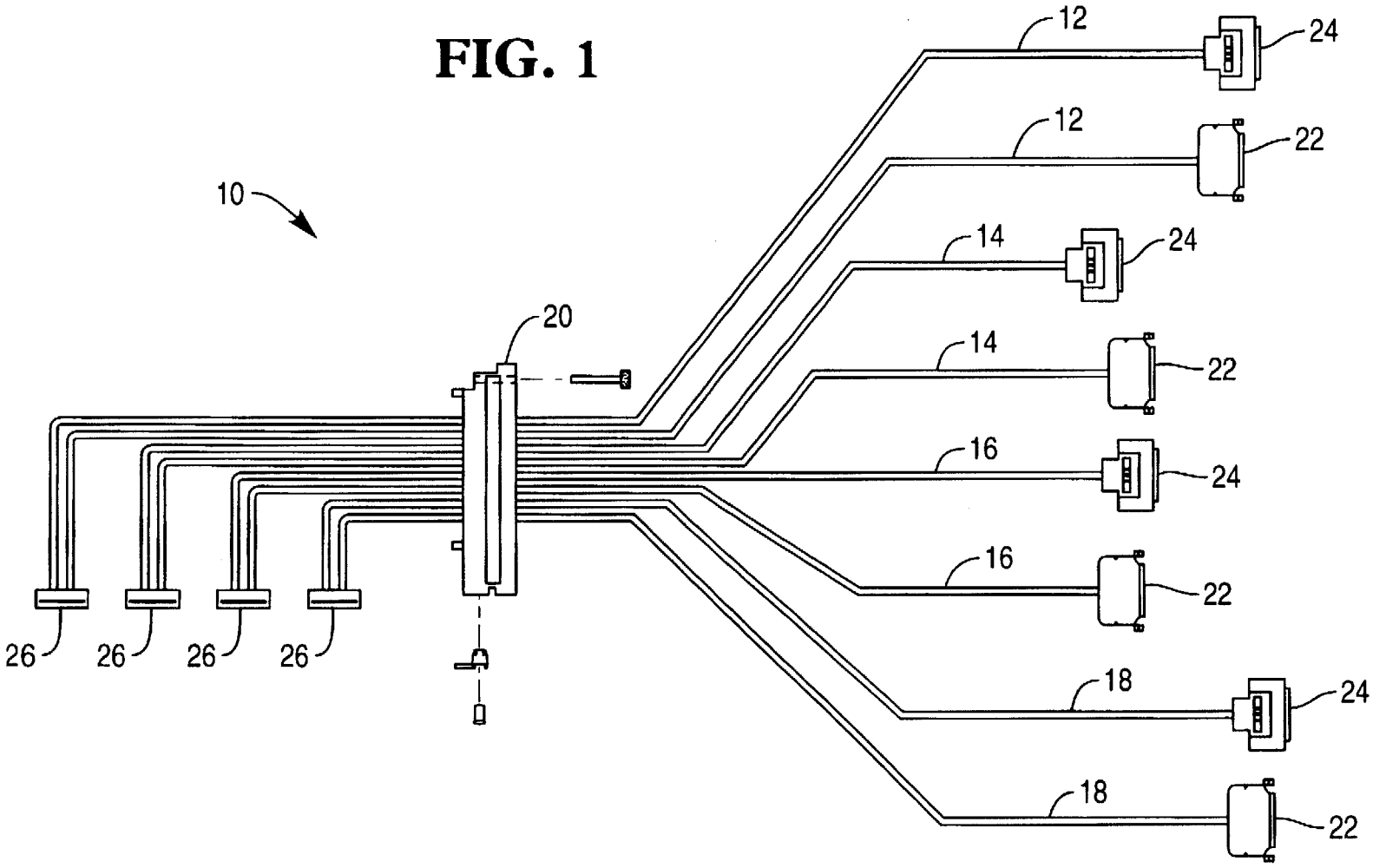
FIG. 1 is plan view illustrating the cable assembly 10 according to the present invention.

FIG. 1 is plan view illustrating the cable assembly 10 described and claimed in the co-pending application Ser. No. 08/580,025, entitled "CABLE ASSEMBLY," filed on same date herewith, by Steve Herman, and assigned to the assignee of this application, which application is incorporated by reference herein. The cable assembly 10 comprises a plurality of cables 12, 14, 16, and 18 coupled or clamped together by a pass-thru bulkhead assembly 20. Each of the cables may comprise a separate shared or unshared SCSI bus, depending on the associated configuration of SCSI adapters and devices coupled thereto.

Each of the cables 12, 14, 16, and 18 in the cable assembly 10 may use any combination of three types of connectors: standard SCSI male connectors 22, standard SCSI female connectors 24, and non-standard SCSI male or female "ribbon cable" connectors 26. All of the connectors 22, 24, and 26 are electrically compatible with the SCSI bus standard. For enhanced efficiency in manufacturing and assembly, each cable 12, 14, 16, and 18 connects at one end to a male connector 22, and at the other end to a female connector 24. Further, each of cables 12, 14, 16, and 18 has a ribbon cable connector 26 at its midpoint for connection to an adapter board.

The male connectors 22 and female connectors 24 electrically interconnect to each of the individually insulated conductors inside the cables 12, 14, 16, and 18. The ribbon cable connectors 26 also electrically interconnect to each of the individually insulated conductors inside the cables 12, 14, 16, and 18. The male connectors 22, female connectors 24, and ribbon cable connectors 26 all electrically connect the cables 12, 14, 16, and 18 to one or more SCSI adapters or devices.

In the embodiment shown in FIG. 1, the default configuration of male connectors 22 and female connectors 24 provides certain advantages for the cable assembly 10. For example, two or more cable assemblies 10 may be coupled together by pairing male connectors 22 to female connectors 24. However, this default configuration is also limiting, because there is no guarantee that the associated device or adapter will provide a complementary match for the connectors 22 or 24. Further, this default configuration also may create problems in terminating the SCSI busses, because SCSI busses are currently terminated at a female connector 24 and available SCSI bus terminators are of a male-type for coupling to the female connector 24. Nonetheless, the manufacture of the cable assembly 10 using the default configuration of male connectors 22 and female connectors 24 is the most efficient possible, since it avoids customizing each cable assembly 10 for its particular application.

In order to enhance the flexibility of the cable assembly 10, and to eliminate the need for customization of the cable assembly 10, the present invention provides a cable connector gender changer for coupling to the male connectors 22 of the cable assembly 10 to provide a female connector 24 at the end of the cable 12, 14, 16, or 18. Thus, the present invention overcomes the requirement of terminating SCSI buses at a female connector 24 of a cable 12, 14, 16, or 18 within the cable assembly 10. Of course, those skilled in the art will recognize that the cable connector gender changer may couple to the female connectors 24 of the cable assembly 10 to provide a male connector 22 at the end of the cable 12, 14, 16, or 18.

Figure 2B:
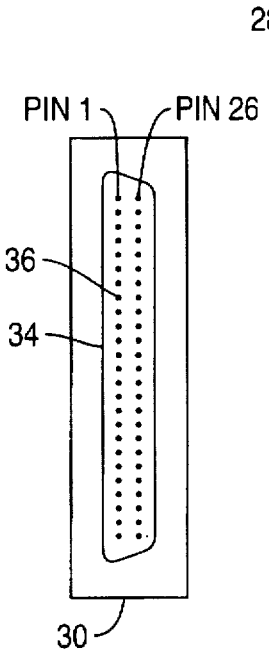
FIGS. 2A, 2B, and 2C, comprise a plan view, left side view, and right side view that illustrate the structure of a cable connector gender changer according to the present invention.
Figure 2A:
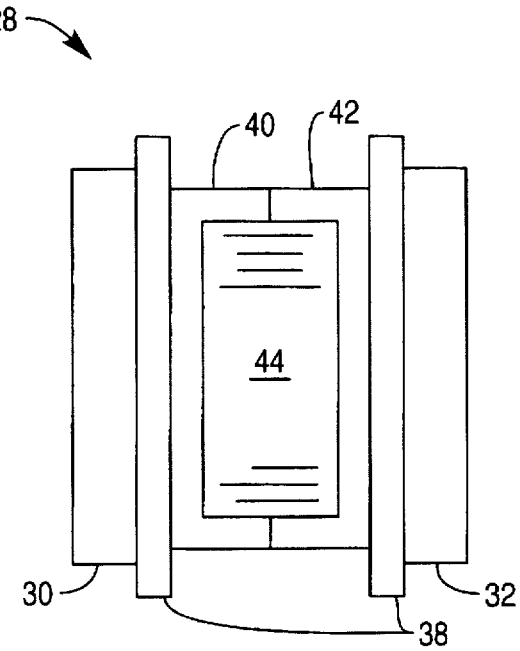
Figure 2C:
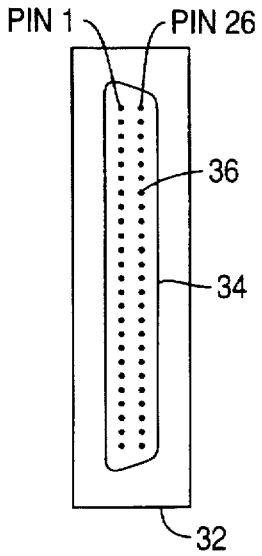

FIGS. 2A, 2B, and 2C, comprise a plan view, left side view, and right side view that illustrate the structure of a cable connector gender changer 28 according to the present invention. The cable connector gender changer 28 allows a male cable connector to connect to another male cable connector or a male terminator. Alternatively, the cable connector gender changer 28 allows a female cable connector to connect to another female cable connector or a female terminator. In the embodiment of FIGS. 2A, 2B, and 2C, the cable connector gender changer 28 is constructed for coupling with narrow (i.e., 50-pin) male connectors 22 on the SCSI cables 12, 14, 16, or 18, or with male terminators. The connectors 30 and 32 on either side of the gender changer 28 each contain a metal socket 34 for coupling to a male connector 22 or terminator. Each of the metal sockets 34 contains an array of 50 pin receptacles 36 for mating with a like number of pins in the male connector 22, wherein the pin receptacles 36 are surrounded by insulating material and are electrically interconnected through an intermediate portion of the gender changer 28 to pin receptacles 36 in the opposing socket 34 using conductors or other means. Similarly, in an alternative embodiment, each of the metal sockets 34 would contain an array of 50 pin-outs for mating with a like number of pin receptacles in a female connector 24, wherein the pin-outs are surrounded by insulating material and are electrically interconnected through an intermediate portion of the gender changer 28 to pin-outs in the opposing socket 34 using conductors or other means. The dimensions of the sockets 34 comply with SCSI standards, so they can mate with standard SCSI cable connectors. The metal sockets 34 are defined by an outwardly extending portion containing insulating material and EMI shielding for separating the pin receptacles or pin-outs 36, and a frame or latch block 38 for supporting the protruding portion. The gender changer 28 may have screwlocks (not shown) or other mechanisms for securely coupling it to the male connectors 22 or terminators. The connector shells 40 and 42 are attached together using a mounting plate 44 or other means. Both connector shells 40 and 42 connected together form a continuous EMI shield from one socket 34 to the other. The gender changer 28 is most-molded for appearance.

Figure 3B:
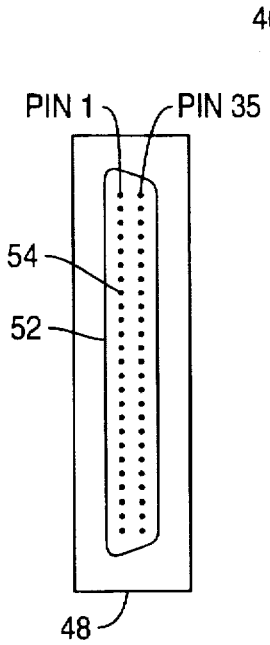
FIGS. 3A, 3B, and 3C, comprise a plan view, left side view, and right side view that illustrate the structure of a cable connector gender changer according to the present invention.
Figure 3A:
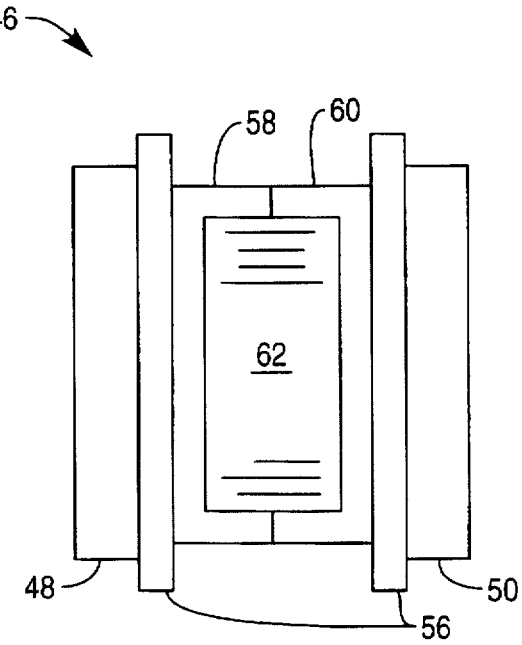
Figure 3C:
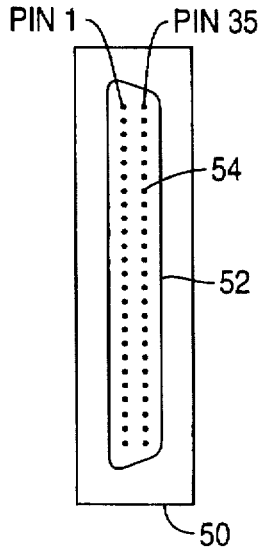

FIGS. 3A, 3B, and 3C, comprise a plan view, left side view, and right side view that illustrate the structure of a cable connector gender changer 46 according to the present invention. Like FIGS. 2A, 2B, and 2C, the cable connector gender changer 46 allows a male cable connector to connect to another male cable connector or a male terminator. Alternatively, the cable connector gender changer 46 allows a female cable connector to connect to another female cable connector or a female terminator. In the embodiment of FIGS. 3A, 3B, and 3C, the cable connector gender changer 46 is constructed for coupling with wide (i.e., 68-pin) male connectors 22 on the SCSI cables 12, 14, 16, or 18, or with male terminators. The connectors 48 and 50 on either side of the gender changer 46 each contain a metal socket 52 for coupling to a male connector 22 or terminator. Each of the metal sockets 52 contains an array of 68 pin receptacles 54 for mating with a like number of pins in the male connector 22, wherein the pin receptacles 54 are surrounded by insulating materials and EMI shielding, and are electrically interconnected through the gender changer 46 to pin receptacles 54 in the opposing socket 52 using conductors or other means. Similarly, in an alternative embodiment, each of the metal sockets 52 would contain an array of 68 pin-outs for mating with a like number of pin receptacles in a female connector 24, wherein the pin-outs are electrically interconnected through an intermediate portion of the gender changer 46 to pin-outs 54 in the opposing socket 52 using conductors or other means. The dimensions of the sockets 52 comply with SCSI standards, so they can mate with standard SCSI cable connectors. The metal sockets 52 are defined by an outwardly extending portion containing insulating material and EMI shielding for separating the pin receptacles 54 or pin-outs, and a frame or latch block 56 for supporting the protruding portion. The gender changer 46 may have screwlocks (not shown) or other mechanisms for securely coupling it to the male connectors 22 or terminators. The connector shells 58 and 60 are attached together using a mounting plate 62 or other means. Both connector shells 58 and 60 connected together form a continuous EMI shield from one socket 52 to the other. The gender changer 46 is post-molded for appearance.

Figure 4:
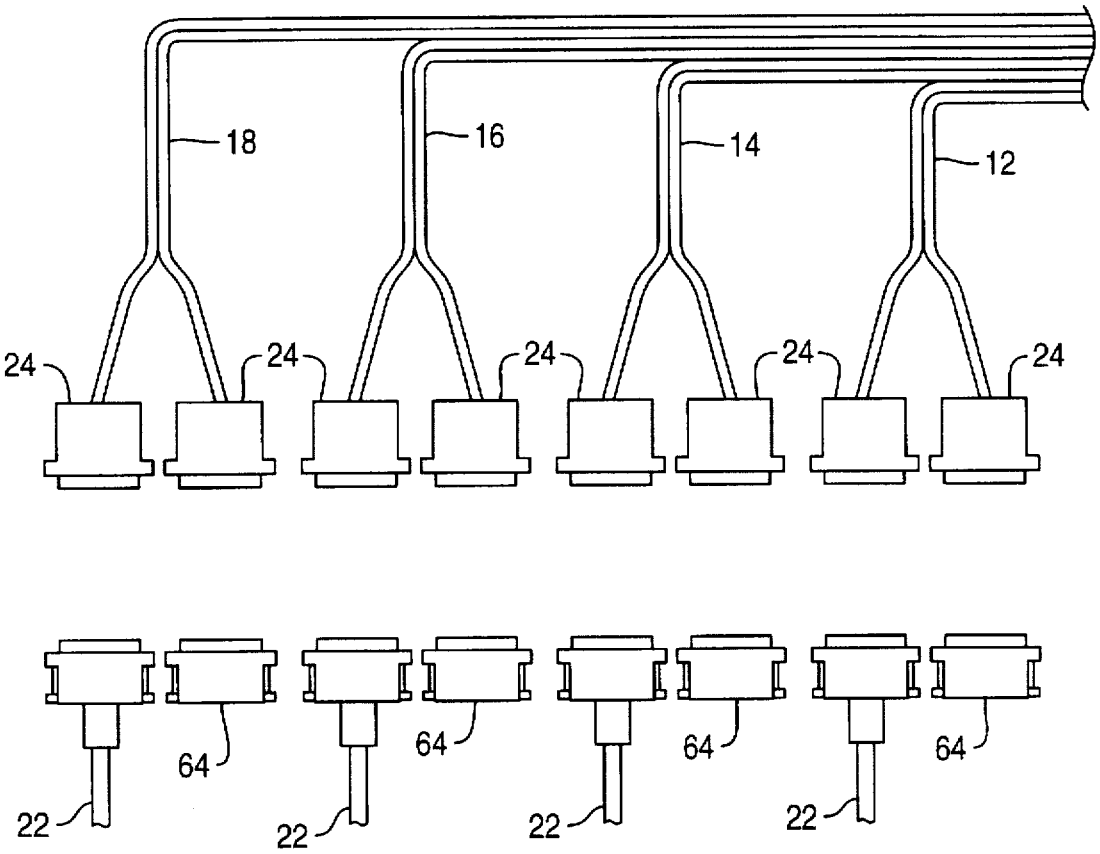
FIG. 4 is a plan view further illustrating an alternative configuration of connectors at the ends of the cables in the cable assembly according to the present invention.

FIG. 4 is a plan view further illustrating an alternative configuration of connectors 24 at the ends of the cables 12, 14, 16, and 18 in the assembly 10 according to the present invention. In this embodiment, the cable assembly 10 is comprised of all female connectors 24 at the ends of the cables 12, 14, 16, and 18. The female connectors 24 can be paired with male connectors 22 or with male terminators 64. Such a configuration further simplifies the manufacture of the cable assembly 10, but increases the use of cable connector gender changers when the female connectors 24 need to be coupled to female connectors 24.

This concludes the description of the preferred embodiment of the invention. In summary, a new and improved cable connector gender changer is disclosed that allows a male cable connector or terminator to connect to another male cable connector. The cable connector gender changer comprises a first metal socket connectable to the male cable connector, a second metal socket connectable to another male cable connector, an intermediate portion for connecting the first and second metal sockets, and a plurality of electrical connections extending from the first metal socket to the second metal socket through the intermediate portion. The dimensions of the sockets comply with SCSI standards, so they can mate with standard SCSI cable connectors or terminators. The gender changer has a continuous EMI shield from one socket to the other and is post-molded for appearance.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited non by this detailed description, but rather by the claims appended hereto.

What is claimed is:

1. A cable assembly comprising:

(a) a plurality of cables for connecting together a plurality of devices, each of the cables comprising a plurality of conductors, a male connector electrically connected to the conductors at a first end of the cable and a female connector electrically connected to the conductors at a second end of the cable;

(b) a pass-thru bulkhead assembly for clamping together the cables, wherein the pass-thru bulkhead assembly comprises one or more guides for each of the clamped-together cables, each of the guides providing an aperture for the cable to pass therethrough, and wherein the pass-thru bulkhead assembly is EMI shielded;

(c) means for mounting the pass-thru bulkhead assembly in an aperture of a cabinet bulkhead; and (d) one or more cable connector gender changers, each of the cable connector gender changers being coupled to a male connector on one of the cables, and each of the cable connector gender changers comprising a first metal socket comprising a first connector shell connectable to the male connector, a second metal socket comprising a second connector shell, an intermediate portion comprising a mounting plate for connecting the first and second metal sockets, and a plurality of electrical connections extending from the first metal socket to the second metal socket through the intermediate portion, wherein the first connector shell, the second connector shell, and the intermediate portion are attached together by the mounting plate into a single unit to form a continuous EMI shield covering said plurality of electrical connections, and wherein the first and second metal sockets are of a same gender type.

2. The cable connector gender changer of claim 1, wherein the second metal socket is connectable to a cable connector.

3. The cable connector gender changer of claim 1, wherein the second metal socket is connectable to a terminator.

4. The cable connector gender changer of claim 1, wherein the second metal socket is a male-type socket.

5. A cable assembly comprising:

(a) a plurality of cables for connecting together a plurality of devices, each of the cables comprising a plurality of conductors, a male connector electrically connected to the conductors at a first end of the cable and a female connector electrically connected to the conductors at a second end of the cable;

(b) a pass-thru bulkhead assembly for clamping together the cables, wherein the pass-thru bulkhead assembly comprises one or more guides for each of the clamped-together cables, each of the guides providing an aperture for the cable to pass therethrough, and wherein the pass-thru bulkhead assembly is EMI shielded;

(c) means for mounting the pass-thru bulkhead assembly in an aperture of a cabinet bulkhead; and (d) one or more cable connector gender changers, each of the cable connector gender changers being coupled to a male connector on one of the cables, and each of the cable connector gender changers comprising a first metal socket comprising a first connector shell, a second metal socket comprising a second connector shell, and intermediate portion comprising a mounting plate for connecting the first and second connector shells, and a plurality of electrical connections extending from the first metal socket to the second metal socket through the intermediate portion, wherein the first connector shell and the second connector shell are attached together by the mounting plate into a single unit to form a continuous EMI shield covering said plurality of electrical connections.

6. The cable connector gender changer of claim 5, wherein the first metal socket is connectable to a cable connector.

7. The cable connector gender changer of claim 5, wherein the second metal socket is connectable to a cable connector.

8. The cable connector gender changer of claim 5, wherein the first metal socket is connectable to a terminator.

9. The cable connector gender changer of claim 5, wherein the second metal socket is connectable to a terminator.

10. The cable connector gender changer of claim 5, wherein the first and second metal sockets are female-type sockets.

11. The cable connector gender changer of claim 5, wherein the first and second metal sockets are male-type sockets.

* * * * *